US011027162B2

(12) United States Patent
Orglmeister

(10) Patent No.: US 11,027,162 B2
(45) Date of Patent: Jun. 8, 2021

(54) METHOD FOR IMPROVING THE HIT ACCURACY OF FIRE-FIGHTING SYSTEMS CONTROLLED BY INFRARED AND VIDEO FIRE DETECTION

(71) Applicant: Albert Orglmeister, Wiesbaden (DE)

(72) Inventor: Albert Orglmeister, Wiesbaden (DE)

( * ) Notice: Subject to any disclaimer, the term of this patent is extended or adjusted under 35 U.S.C. 154(b) by 249 days.

(21) Appl. No.: 15/437,463

(22) Filed: Feb. 21, 2017

(65) Prior Publication Data

US 2017/0259097 A1 Sep. 14, 2017

(30) Foreign Application Priority Data

Mar. 10, 2016 (DE) ..... 102016104349.4

(51) Int. Cl.

| | |
|---|---|
| ***A62C 37/10*** | (2006.01) |
| ***A62C 37/40*** | (2006.01) |
| ***A62C 31/28*** | (2006.01) |
| ***A62C 99/00*** | (2010.01) |
| *A62C 3/00* | (2006.01) |

(52) U.S. Cl.

CPC ..... *A62C 37/10* (2013.01); *A62C 31/28* (2013.01); *A62C 37/40* (2013.01); *A62C 99/009* (2013.01); *A62C 3/002* (2013.01)

(58) Field of Classification Search

CPC ..... A62C 37/08; A62C 37/10; A62C 37/36; A62C 37/40; A62C 3/0292

USPC ..... 169/47

See application file for complete search history.

(56) References Cited

U.S. PATENT DOCUMENTS

| | | | | |
|---|---|---|---|---|
| 6,851,483 | B2 * | 2/2005 | Olander | A62C 5/00 169/26 |
| 7,066,273 | B2 * | 6/2006 | Tan | A62C 37/40 169/23 |
| 7,333,129 | B2 * | 2/2008 | Miller | A62C 35/08 348/143 |
| 7,451,028 | B2 * | 11/2008 | Pillar | B60L 3/12 701/50 |
| 8,245,790 | B2 * | 8/2012 | Lozier | A62C 27/00 169/43 |
| 8,606,373 | B2 * | 12/2013 | Lozier | A62C 37/00 700/15 |
| 9,662,519 | B2 * | 5/2017 | Livchak | A62C 37/36 |
| 2006/0289175 | A1 * | 12/2006 | Gutowski | A62C 37/10 169/46 |
| 2013/0264074 | A1 * | 10/2013 | Lewis | A62C 37/36 169/46 |
| 2015/0021054 | A1 * | 1/2015 | McNamara | A62C 37/40 169/46 |

(Continued)

*Primary Examiner* — Joseph A Greenlund

(74) *Attorney, Agent, or Firm* — Michael Soderman

(57) ABSTRACT

A method for improving the hit accuracy of fire detection systems controlled by infrared and video fire detection by means of a first IR/video camera system for the first detection unit (D1) to ensure continuous fire detection and a second IR/video camera system for the second detection unit (D2) to ensure automatic target tracking with respect to the source of fire, as well as to an extinguisher launcher (A) rigidly connected to the second detection unit. The method is characterised by steps through which video/infrared-controlled extinguishing systems can be precisely hit with regard to the target precision, and fires can be combated as quickly as possible, even in the early phase, with as little extinguishing agent as possible.

1 Claim, 3 Drawing Sheets

(56) References Cited

U.S. PATENT DOCUMENTS

| | | | | |
|---|---|---|---|---|
| 2016/0030784 | A1* | 2/2016 | Tsutaki | A62C 3/0292 169/61 |
| 2016/0059057 | A1* | 3/2016 | Disimile | A62C 3/08 169/46 |
| 2016/0271434 | A1* | 9/2016 | Dusing | A62C 37/40 |
| 2016/0321900 | A1* | 11/2016 | Rao | B05B 12/12 |
| 2016/0354626 | A1* | 12/2016 | McNamara | A62C 37/40 |
| 2017/0259097 | A1* | 9/2017 | Orglmeister | A62C 37/10 |

* cited by examiner

METHOD FOR IMPROVING THE HIT ACCURACY OF FIRE-FIGHTING SYSTEMS CONTROLLED BY INFRARED AND VIDEO FIRE DETECTION

CROSS REFERENCE TO RELATED APPLICATIONS

This application claims the priority of DE 102016104349.4 filed on 2016 Mar. 10; this application is incorporated by reference herein in its entirety.

BACKGROUND

The invention relates to a method for improving the hit accuracy of the fire detection system controlled by infrared and video fire detection by means of a first IR/video camera system for the first detection to ensure continuous fire detection and a second IR/video camera system for the second detection to ensure automatic target tracking to the hearth of the fire, as well as to an extinguisher rigidly connected to the second detection.

Increasingly, more and more infrared detectors, in particular infrared cameras and video cameras, have been used for early fire detection in waste incineration plants, recycling plants, warehouses and the like. This makes it possible to detect fires in the early phase and to report it to a subsequent fire alarm system. As an extension, fire extinguishing systems, in particular fire monitors—also referred to as extinguishing guns or extinguisher launchers—are increasingly used as an extension as accurate fire extinguishing agent on a nascent fire.

At the moment there are already infrared (IR)/video camera controlled fire extinguishing systems, which however produce unsatisfactory aiming accuracies. In these systems, the aiming is by means of an IR camera, which is mounted at a certain distance from the extinguisher launcher, as is known from WO2004/052433 A1, or an IR camera is fixedly mounted on the movable arm of the ejector, which is directed to the fire area. Both methods, however, generate system-related errors which do not allow accurate alignment of these extinguishing systems.

Furthermore, an extinguisher launcher controller is known from DE 196 01 282 C1, wherein an automatic alignment of the launcher tube with respect to the source of fire is effected by means of a laser removal thermometer measuring device. To do so, the distance to the object to be extinguished and the temperature of the object to be extinguished are measured, and the launcher tube is thereby aligned.

EP 2 705 881 A1 shows a device for controlling extinguisher launchers by means of a control system and has a position table which geometrically maps the target positions of the extinguishing medium. In this case, the position table preferably consists of a pressure-sensitive touchpad or a computer-based intelligent tablet PC, whereas the position table is labelled or printed with the geometrical target areas of the extinguisher monitor, for example, with a sketch of the extinguishing object.

Furthermore, from US Pat. No. 2016/0030784 A1, a fire detection device is known which uses, as a base, electromagnetic waves which are sent to the source of fire and which are again received and evaluated by a receiver/transmitter by return.

Furthermore, DE 10 2006 025 286 B3 discloses a device for detecting large-area thermal images on a monitor with a thermal camera in a pivoting housing. Real-time synchronization of the camera position and the real-time thermal image is carried out by synchronizing the camera drive with the camera signal, whereby the camera moves in real time according to the set scan speed over the space to be detected. The scanned individual images are merged together on the monitor and are updated continuously to form a whole thermal image.

In essence, the spread of a fire is combated in the earliest possible stage, which can prevent large fires in the case of materials prone to flash fire.

FIG. 1 shows the schematic arrangement of an infrared/video camera controlled extinguishing system. A first IR/video camera-1 normally detects the area to be monitored. This is schematically shown here as a surface. However, a complicated, spatial arrangement could also be monitored. An example can be a football stadium that is captured by an infrared camera attached to the hanging display block in the centre of the stadium. In this case, a hemispherical space would have to be detected.

This area can be captured either by optics specially designed for the spatial requirements, i.e. optics that define a room with special 180° optics—also as a recording of a hemispherical space—or by scanning camera systems which detect and compound the monitoring area on the basis of individual images or compounded individual images as a panoramic image.

The larger the area to be monitored is, or the more complicated the shape of the area to be monitored, eg, the hemispherical space in the football stadium, the more distorted the image of the IR or video image from which the space coordinates are calculated to direct the launcher.

FIG. 2 shows, as an example, a composite IR image of a delivery hall for recycled material, which covers a space of approximately 80×30 m from a height of approximately 20 m. Here, the wide-angle effect—also known as the fish eye—can be clearly seen. This in particular produces distortions with a lower geometric resolution in the edge area. This simple geometric detection area results in resolution errors which worsen the control of an extinguisher launcher by up to about 4° in some areas.

Further imaging errors can result from the following effects:

1. It is difficult to install an IR/video camera system absolutely with an axis parallel to the monitoring area since the roof structures, for example in buildings where the detection unit is mounted, are not designed to be absolutely parallel to the floor surface.
2. There is also the possibility that roofing beams or other mounting parts on which the detection unit is mounted, can rotate by thermal expansion due to different temperatures from winter to summer.
3. It is almost impossible to install an extinguisher launcher, which is controlled by the coordinates of the detection unit, as well as with an axis parallel to the monitoring area. In most cases, a fire-extinguisher is flanged onto an extinguishing agent-carrying tube. This causes further angular errors between the fire detection device and the unit for activating the extinguishing agent.
4. If the IR or video image is captured by a scanning system, an additional angle error is likely to be present.
5. The control of a target by means of a commercially available extinguisher launcher adds again a further angular error of at least +/−2° to the hit accuracy, since these extinguisher launchers are more suitable for manual actuation by means of joystick controls, in which larger angular errors do not play any role.

6. Because of technical reasons, extinguisher launchers and IR/video camera detection unit can be spatially separated over longer distances, an additional angle error can occur depending on the distance between the extinguisher launcher and the detection unit via the mathematical coordinate transformation.

If the possible angular errors from the mentioned possible sources of error are summed up, an angular error in the direction of rotation can be easily produced for the control of targeted extinguisher launcher systems of approximately +/−8°.

FIG. 3 shows the most frequently used motion control of an extinguisher launcher. This consists of a rotational movement of up to 360° and a tilting movement of up to +/−90° to the horizontal.

Observation of the angular error of an IR/video camera controlled extinguisher launcher system with respect to the rotary motion:

Fire extinguishing systems used in recycling systems are hydraulically dimensioned in such a way that they reach an average range of approx. 50 m. This results in a circle circumference of the possible extinguishing range of $2\pi r=2\times50\times3.14=314$ m circumference. If the 314 m circumference is divided by 360°, a possible target deviation of approx. 0.9 m per angular degree is obtained.

With a throw distance of 50 m, the result is a hit accuracy of +/−8°×0.9 m, thus an approximate hit accuracy of +/−7 m. This corresponds to a hit accuracy range of 14 m.

Observation of the angular error of an IR/video camera controlled extinguisher launcher system with respect to the tilting motion:

The tilting of the extinguisher launcher is responsible for the throwing distance of the extinguishing agent.

Other factors that influence the throw range are added to the already mentioned error possibilities:

1. The uniformity of the extinguishing agent pump capacity, which influences the throwing parabola of the extinguishing agent via the exit velocity at the exit of the extinguisher launcher and is thus responsible for the coverage of the extinguishing agent jet.
2. On the density of the extinguishing agent which in turn depends on the composition (eg water and extinguishing agent additives) and the extinguishing agent temperature.
3. On the nature of the application of the extinguishing agent (hollow jet or spray jet variation).
4. On the throwing characteristic of the extinguishing agent. Foam behaves differently from water.

At best, for a throwing distance of 50 m, the hit accuracy therefore is at least +/−6 m.

Attempts are currently being made to improve these hit inaccuracies by extinguishing tests and the resulting angle correction values. However, this requires several extinguishing attempts. In a first step, a first hit profile is recorded via extinguishing attempts.

The calculated correction values are checked in a second series of extinguishing tests.

In practice, however, the correction values have to be improved several times. This is indeed an empirical approximation method. At the present time, this angle correction method is also capable of achieving a maximum hit accuracy in the rotational movement of +/−5°. This is a 50 m distance +/−4.5 m. In the tilting of the extinguisher launcher, a similar inaccuracy is obtained.

Furthermore, by means of this approximation method, it is not ensured that the entire system does not change in its hit accuracy due to aging, mechanical drift due to constant pressure changes on the entire system or due to errors in the electronics.

It is thus disadvantageous:

1. To extinguish a small firing at a distance of 50 m, it must be possible to extinguish at least a range of 7×7 m, for reliable hit accuracy.
2. Since fire extinguishers with quantities of 2500 l/min of extinguishing agent are used, the result is quick consumptions of extinguishing agent of at least 50,000 l for setting up an extinguisher launcher.
3. Due to the aging of the launcher or the detection unit or after a repair of these components combined with a disassembly/assembly, new mechanical inaccuracies may result which require a readjustment with test extinguishments.

SUMMARY

The invention concerns a method for improving the hit accuracy of fire detection systems controlled by infrared and video fire detection by means of a first IR/video camera system for the first detection unit (D1) to ensure continuous fire detection and a second IR/video camera system for the second detection unit (D2) to ensure automatic target tracking with respect to the source of fire, as well as to an extinguisher launcher (A) rigidly connected to the second detection unit. The method is characterised by steps through which video/infrared-controlled extinguishing systems can be precisely hit with regard to the target precision, and fires can be combated as quickly as possible, even in the early phase, with as little extinguishing agent as possible.

DETAILED DESCRIPTION

It is an object of the invention to provide a method of the type mentioned at the onset, with which video/infrared-controlled extinguishing systems can be hit the target with precision, and fires can be combated as quickly as possible, even in the early phase, with as little extinguishing means as possible.

The object is satisfied by the invention by

- determination of the deviation (F1) of the centre point of the extinguishing agent jet (F) in the direction of rotation of the extinguisher launcher (A) to the centre point (M) of the detection area of the second detection area 2 (D2) by a single test measurement with an extinguishing agent on the source of fire (G),
- coarse alignment of the extinguisher launcher (A) with the source of fire, by means of the position of the source of fire (G) as determined with detection unit 1 (D1),
- determination by means of detection unit 2 (D2) of the deviation (G1) of the centre point of the source of fire (G) to the centre point (M) of the detection area (E) of the detection unit 2 (D2),
- counterbalancing by the movement of the extinguisher launcher (A) in its rotation (C) towards zero,
- determination of the width of the horizontal angular range, namely the width of the detected source of fire (G), by means of detection unit 2 (D2), wherein
  - the extinguisher launcher (A) is moved until it is displaced with the centre point (M) of the detection area (E) of the detection unit 2 (D2) from the side of the firing point (G) to the other side of the source of fire (G), or
  - the angular range from the horizontal number of the image points of the thermal image describing the width of the source of fire (G) is set in relation to the number of all heat images available in the horizontal direction, with the associated detection angle, Detection of the coincidence of the centre point (M) of the detection area (E) of the detection unit 2 (D2) with the centre point of the extinguishing agent jet (F), wherein knowing the horizontal and vertical distances (X) and (Y) of the exit of the extinguishing agent of the extinguisher launcher (A) towards the source of fire (G) enables to calculate the tilting of the extinguisher launcher (A) based on a trajectory determined empirically a single time, inasmuch as the extinguisher launcher (A) is set in such a way that said launcher is aligned to the maximal theoretically and necessary throwing width and the throwing width deviation between the actual value and the setpoint value from which the real throwing parabola is calculated, is determined by a single triggering of the extinguishing process, or when the horizontal and vertical distance of the exit of the extinguishing agent of the extinguisher launcher (A) towards the source of fire (G) is not known, the distance is measured by triangulation and calculated by means of trigonometric functions based on alignment angles of the detection unit 1 and detection unit 2 with respcet to the source of fire (G), Adjustment by means of the movement of the extinguisher launcher (A) in its tilting towards the center of the source of fire (G).

The method according to the invention enables video/infrared-controlled extinguishing systems to hit precisely the sources of fire detected, and to fight fires as quickly as possible, i.e. in the early phase, with as little extinguishing agent as possible. This saves time in combating the fire, since the greatest possible quantity of fire extinguishing agent is applied to the source of fire with greatest accuracy. Furthermore, the environment is spared because the wetting and foaming agents admixed to the extinguishing water are harmful and partly toxic to the environment. In addition, a lower consumption of extinguishing agent also means less storage of extinguishing agents.

BRIEF DESCRIPTION OF THE DRAWINGS

The idea underlying the invention is illustrated in more detail in the following description of the method with reference to the drawings. The figures are as follows.

DETAILED DESCRIPTION OF THE PREFERRED EMBODIMENTS

Figure 1:
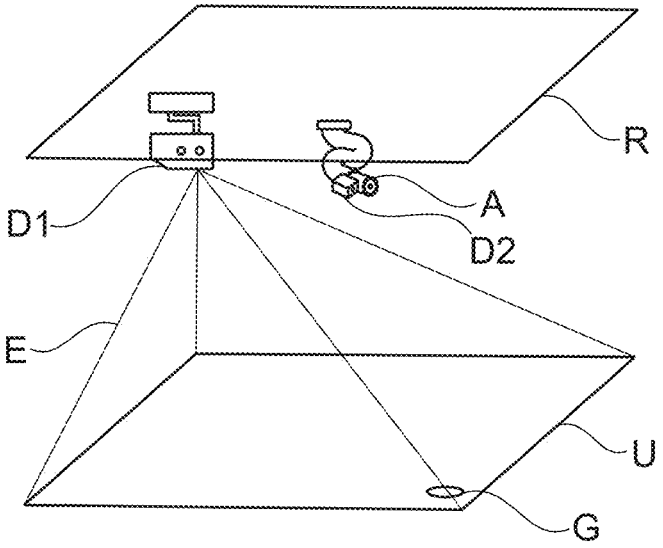
FIG. 1 shows a schematic arrangement of an IR/video camera controlled fire extinguishing system with an extinguisher launcher.
Figure 2:
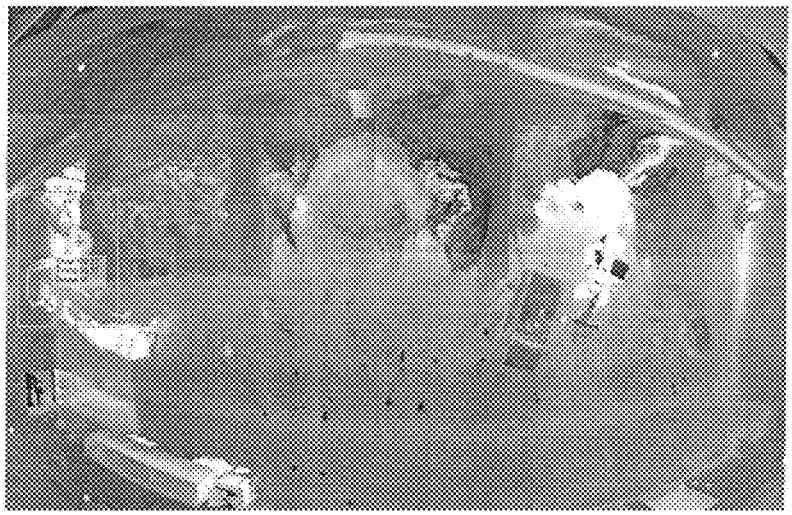
FIG. 2 shows an infrared image or panoramic thermography, for example, of a delivery hall for recycling material.
Figure 3:
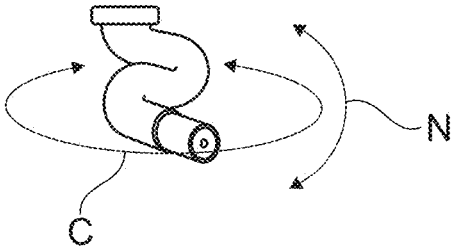
FIG. 3 is a schematic representation of the most frequently used motion control of an extinguisher launcher.

FIG. 1 represents a monitoring area U, in which a source of fire G could be produced, in a room with a lid R. Two IR/video camera systems (hereinafter, referred to as detection unit 1 and detection unit 2, respectively) are used to improve the hit accuracy. The detection unit 1 D1 is responsible for the continuous fire detection. In the case of a detection of a source of fire G, the coarse coordinates for the alignment of an extinguisher launcher A are calculated. However, these are very inaccurate because of the above-described conditions.

The detection unit 1 D1 and the extinguisher launcher A are attached to the lid R.

The detection unit 2 D2, which is rigidly connected to the movable part of the extinguisher launcher A, which is directly aimed at the source of fire G, can secure automatic target tracking now actively.

For improved hit accuracy with respect to the rotary motion of the extinguisher launcher A:

Usually, there might be a deviation of the centre point of the extinguishing agent jet F in the direction of rotation C of the extinguisher launcher A with the centre point M of the detection area E of the detection unit 2 without prior adjustment of both axes.

The horizontal deviation F1 of the extinguishing agent beam F with respect to the centre point M of the detection area E can be easily determined by means of a single test measurement with the extinguishing agent. Due to the rigid coupling between the extinguisher launcher A and the detection unit 2, a long-term drift is almost impossible. Therefore, a readjustment can be dispensed with.

If the deviation F1 is known, the procedure described below follows:

The extinguisher launcher A is roughly aligned with the source of fire, on the base of the position of the source of fire G determined with the detection unit 1. The deviation G1 or G2 of the centre point of the source of fire G with respect to the centre point M of the detection region E of the detection unit 2 is then determined by means of the detection using 2 and is adjusted to zero by the method of the extinguisher launcher in its rotational movement C. In this case, the deviation F1, which has been determined as described above, must be taken into account as an angle constant.

The width of the horizontal angular range, that is, the width of the detected source of fire G, through which the extinguisher launcher A must be moved in order to completely extinguish the source of fire G, can be determined via the detection unit 2, which is rigidly connected to the extinguisher launcher A.

This can be achieved by two methods:

1. The extinguisher launcher A is moved until it is displaced with the centre point M of the detection area E of the detection unit 2 from the side of the firing point G to the other side of the source of fire G.

2. The angle is calculated from the horizontal number of the image points of the thermal image, which describe the width of the source of fire G, by setting it in relation to the number of image points, i.e. the thermal image points available in the horizontal direction. The associated detected angular range of the IR or video camera can normally be taken from the data sheet of the camera used.

Figure 4:
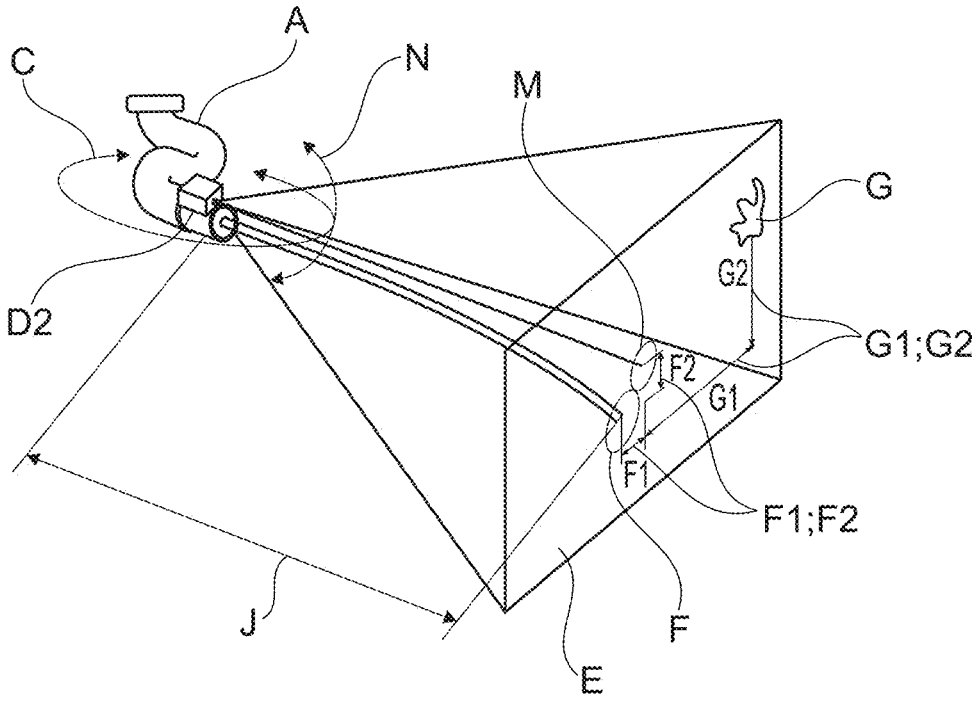
FIG. 4 shows a schematic representation of the components on the extinguisher launcher according to FIG. 3 for describing the method according to the invention for improving the hit accuracy.

For improved hit accuracy with respect to the tilting movement N of the extinguisher launcher A:

Ideal for improving the hit accuracy in the tilting movement N of the extinguisher launcher A would be a coincidence of the centre point M of the detection area E of the detection unit 2 with the centre point of the extinguishing agent jet F according to FIG. 4.

Since the course of the extinguishing agent jet F, as soon as it is applied at an angle to the earth attraction, has a parabolic course which is related to the exit velocity of the extinguishing agent, the application angle to the attracting force and the material composition (eg water/foam ratio), it always deviates from this ideal line. This vertical deviation describes F2.

Figure 6:
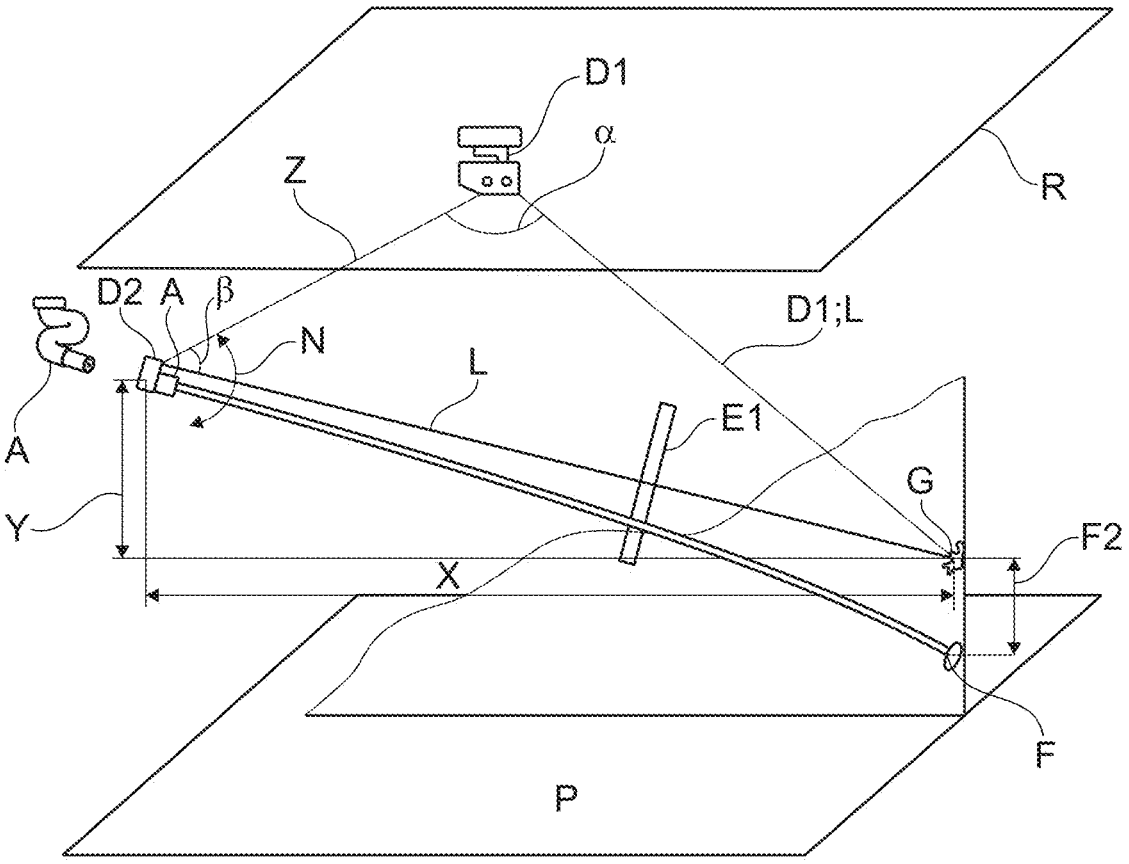

If the distances X and Y according to FIG. 6 and thus the distance J of the extinguishing agent exit of the extinguishing device A to the source of fire G are known, the tilting of the extinguishing launcher A can be calculated from a trajectory empirically determined a single time. To do so, the extinguisher launcher A is set in such a way that said launcher is aligned to the maximal theoretically and necessary throwing width. The throwing width deviation between the actual value and the setpoint value is determined by a single triggering of the extinguishing process. This enables to calculate the real throwing parabola. If a tilting range is steered instead of a calculated inclination angle, any pressure fluctuations and fluctuations of the extinguishing agent composition are compensated.

If the distance J of the extinguishing agent exit of the extinguishing launcher A from the source of fire G is not known, the distance J must be determined. Currently, no IR/video camera system provides useful distance information to the source of fire detected.

Especially when measuring the distance of recycled material, conventional, inexpensive distance measuring systems can be based on laser or radar, since said systems are not able to reflect clearly in the diffuse surface of the material P to be monitored and thus do not provide usable measuring data.

The use of two IR/video camera systems of the described method allows distance measurement by triangulation according to FIG. 6. Triangulation is a geometric method of optical distance measurement by precise measurement of angles a and 13 within triangles and reference lines Z. The calculation is based on trigonometric functions.

Figure 5:
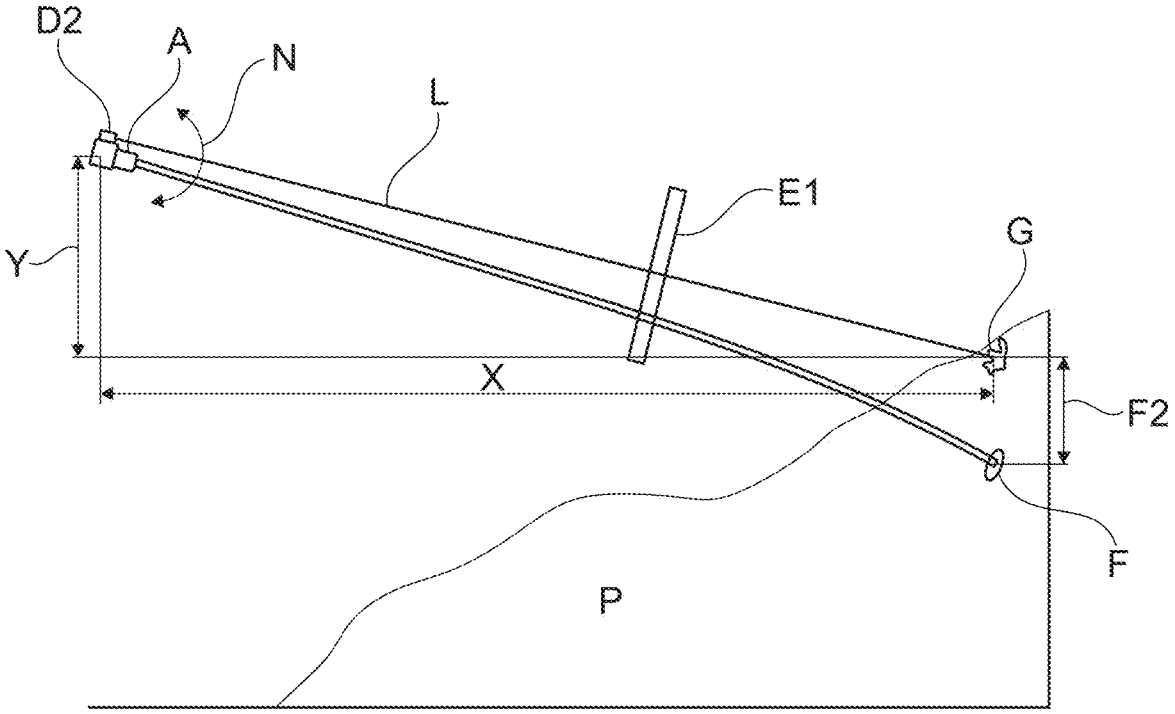
FIG. 5 is a schematic representation of the fire extinguishing system by means of an extinguishing launcher for describing the method for improving the hit accuracy during the tilting movement and FIG. 6 is a schematic representation of the use of two IR/video camera systems of the described method allows distance measurement by triangulation.

FIGS. 5 and 6 also show the optional possibility of using a marking laser L which linearly marks the centre of point of the detection area E of the detection unit 2 D2. With E1, only the vertical portion of the detection area of the detection unit 2 D2 is shown.

LIST OF REFERENCE NUMERALS

A Extinguisher launcher
C Rotation; rotation direction; rotation movement of the extinguisher launcher A
D1 Detection unit 1
D2 Detection unit 2
E Detection area of the detection unit 2
E1 Vertical portion of the detection area E
F Extinguishing agent jet
F1 Horizontal deviation of the extinguishing agent jet F
F2 Vertical deviation of the extinguishing agent jet F
G Source of fire
G1, G2 Deviation of the centre point of the source of fire G from the centre point M of the detection area E of the detection unit 2
J Distance from the extinguishing agent exit of the extinguisher launcher A to the source of fire
L Marking laser
M Centre point of the detection area E
N Tilting movement of the extinguisher launcher A
P Monitored material
R Lid
U Monitoring area
X Distance from the extinguishing agent exit of the extinguisher launcher A to the source of fire G
Y Vertical distance from the extinguishing agent exit of the extinguisher launcher A to the source of fire G
Z Triangles or reference lines
α Alignment angle; angle for Z
β Alignment angle; angle for Z

The invention claimed is:

1. A method for improving hit accuracy of fire detection systems controlled by infrared and video fire detection by means of a first IR/video camera system for a first detection unit (D1) to ensure continuous fire detection and a second IR/video camera system for a second detection unit (D2) to ensure automatic target tracking with respect to the source of fire, as well as to an extinguisher launcher (A) rigidly connected to the second detection unit (D2), comprising the steps:

in a first step, a deviation (F1) of a centre point of an extinguishing agent jet (F) in a direction of rotation (C) of the extinguisher launcher (A) to a centre point (M) of a detection area (E) of the second detection unit (D2) is determined, in a second step, coarse alignment of the extinguisher launcher (A) with the source of fire is performed, by means of the position of the source of fire (G) as determined with the first detection unit (D1), in a third step, a deviation (G1) of a centre point of the source of fire (G) to the centre point (M) of the detection area (E) of the second detection unit (D2) is determined by means of the second detection unit (D2), in a fourth step, settling is brought about by means of the extinguisher launcher (A) in its rotation (C) towards zero, in a fifth step, a width of a horizontal angular range is determined, namely the width of the detected source of fire (G), by means of the second detection unit (D2), wherein the extinguisher launcher (A) is moved until it is displaced with the centre point (M) of the detection area (E) of the second detection unit (D2) from a side of the source of fire (G) to another side of the source of fire (G), or an angular range from a horizontal number of image points of a thermal image describing the width of the source of fire (G) is set in relation to a number of all heat images available in a horizontal direction, with an associated detection angle, in a sixth step, a coincidence of the centre point (M) of the detection area (E) of the second detection unit (D2) with the centre point of the extinguishing agent jet (F) is detected, wherein when horizontal and vertical intervals (X) and (Y) of an exit of an extinguishing agent of the extinguisher launcher (A) towards the source of fire (G) are known a tilting of the extinguisher launcher (A) is calculated based on a trajectory determined empirically a single time, inasmuch as the extinguisher launcher (A) is set in such a way that said launcher is aligned to a maximal theoretically and necessary throwing width and the throwing width deviation between an actual value and a setpoint value from which a real throwing parabola is calculated, is determined by a single triggering of an extinguishing process, or when a horizontal (X) and vertical (Y) distance of the exit of the extinguishing agent of the extinguisher launcher (A) towards the source of fire (G) is not known, the distance is measured by triangulation and calculated by means of trigonometric functions based on alignment angles ($\alpha$; $\beta$) of the first detection unit (D1) and the second detection unit (D2) with respect to the source of fire (G), in a seventh step, an adjustment is performed by means of the movement of the extinguisher launcher (A) in its tilting towards the center of the source of fire (G).

* * * * *